US005220126A

United States Patent [19]

Borgwarth et al.

[11] Patent Number: 5,220,126

[45] Date of Patent: Jun. 15, 1993

[54] HIGH ENERGY INTERMITTENT POWER CONNECTOR

[75] Inventors: Dennis Borgwarth, Anoka; Mark E. Schneider, Minneapolis; Steven R. Stricker, Brooklyn Center; Steven R. Zelenak, Maple Grove, all of Minn.

[73] Assignee: FMC Corporation, Chicago, Ill.

[21] Appl. No.: 749,040

[22] Filed: Aug. 23, 1991

[51] Int. Cl.[5] ..... F41A 19/69

[52] U.S. Cl. ..... 89/28.05; 102/472; 200/51.12; 439/852

[58] Field of Search ..... 42/84; 89/28.05, 28.1, 89/135; 102/202.9, 472; 200/51.02, 51.08, 51.11, 51.12; 439/851, 852, 856; 313/134, 143

[56] References Cited

U.S. PATENT DOCUMENTS

| | | | |
|---|---|---|---|
| 2,055,408 | 9/1936 | Hahn | 313/134 |
| 2,273,651 | 2/1942 | Lude | 313/143 |
| 2,466,929 | 4/1949 | Catlin et al. | 89/28.05 |
| 3,094,932 | 6/1963 | Greenlees | 42/84 |
| 3,145,069 | 8/1964 | Damon et al. | 439/851 |
| 3,363,565 | 1/1968 | Walther | 102/472 |
| 4,895,062 | 1/1990 | Chryssomallis et al. | 89/7 |

FOREIGN PATENT DOCUMENTS

| | | | |
|---|---|---|---|
| 2420035 | 3/1976 | Fed. Rep. of Germany | 42/84 |
| 2949130 | 6/1981 | Fed. Rep. of Germany | 89/28.05 |
| 3814419 | 9/1989 | Fed. Rep. of Germany | 102/472 |
| 519341 | 3/1940 | United Kingdom | 42/84 |

*Primary Examiner*—Stephen C. Bentley

*Attorney, Agent, or Firm*—H. M. Stanley; R. C. Kamp; R. B. Megley

[57] ABSTRACT

The apparatus and method disclosed herein relates to axially aligned electrical contacts which connect a high electrical power pulse forming network to an electrothermal ammunition integrated plasma injector in a combustion augmented plasma gun for launching projectiles thereof. The contacts transfer high energy, intermittent pulses without arcing because structure provides for axially preloading the contacts to reduce contact resistance, for axially stiffening the contacts to eliminate contact bounce and for providing complementary conical contact surfaces to facilitate a high current density transfer.

13 Claims, 2 Drawing Sheets

FIG_1A
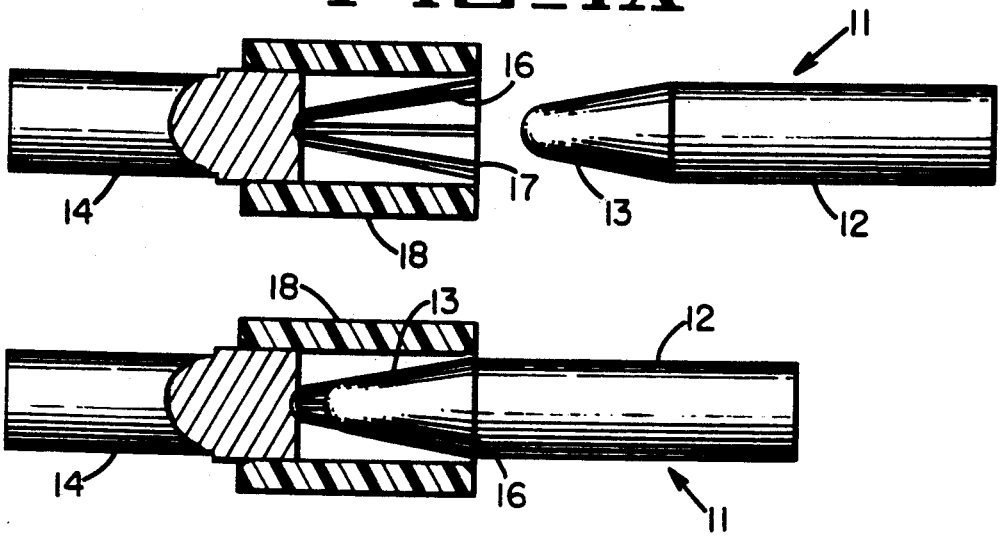
FIG_1B
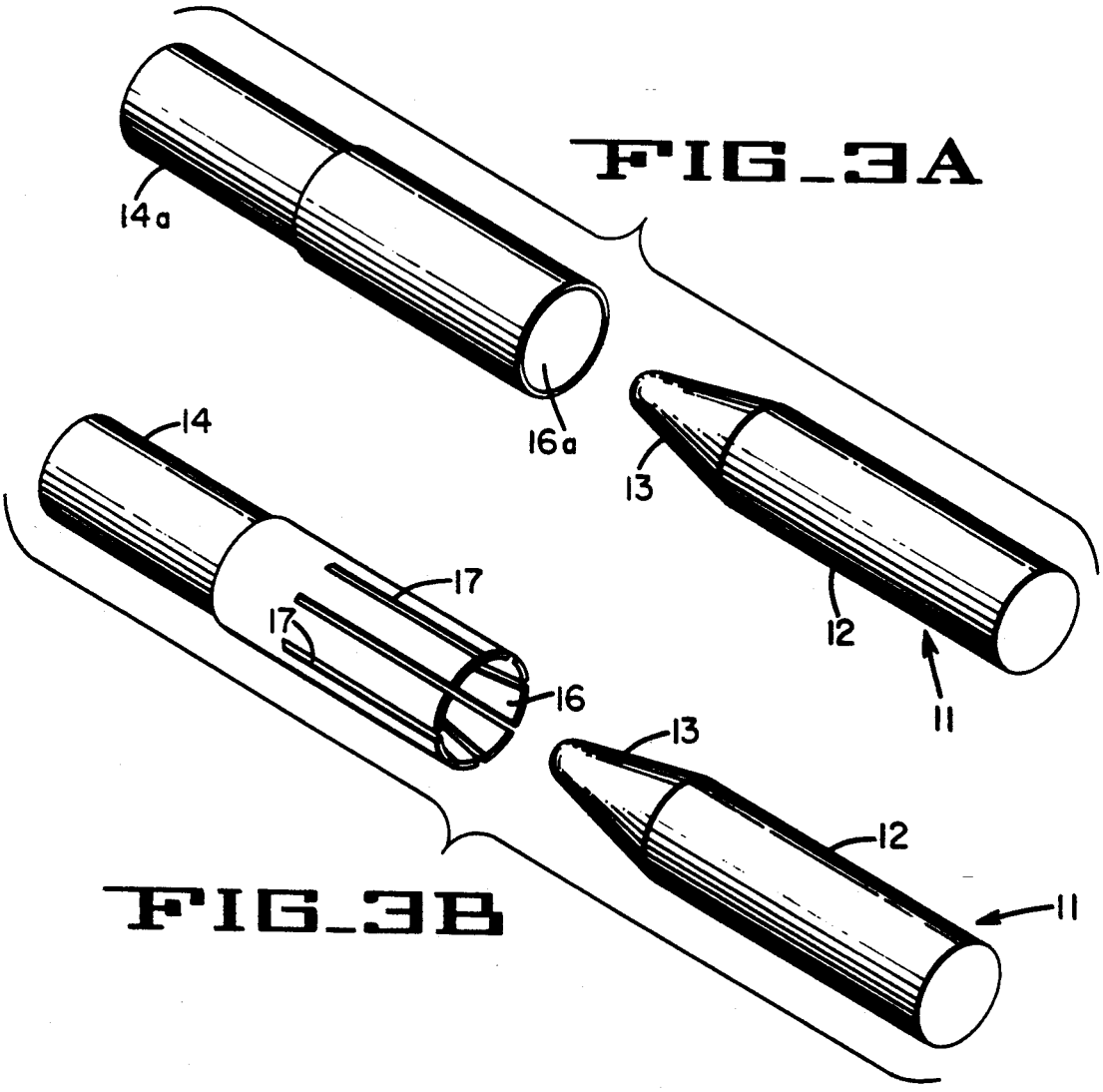
FIG_3A
FIG_3B

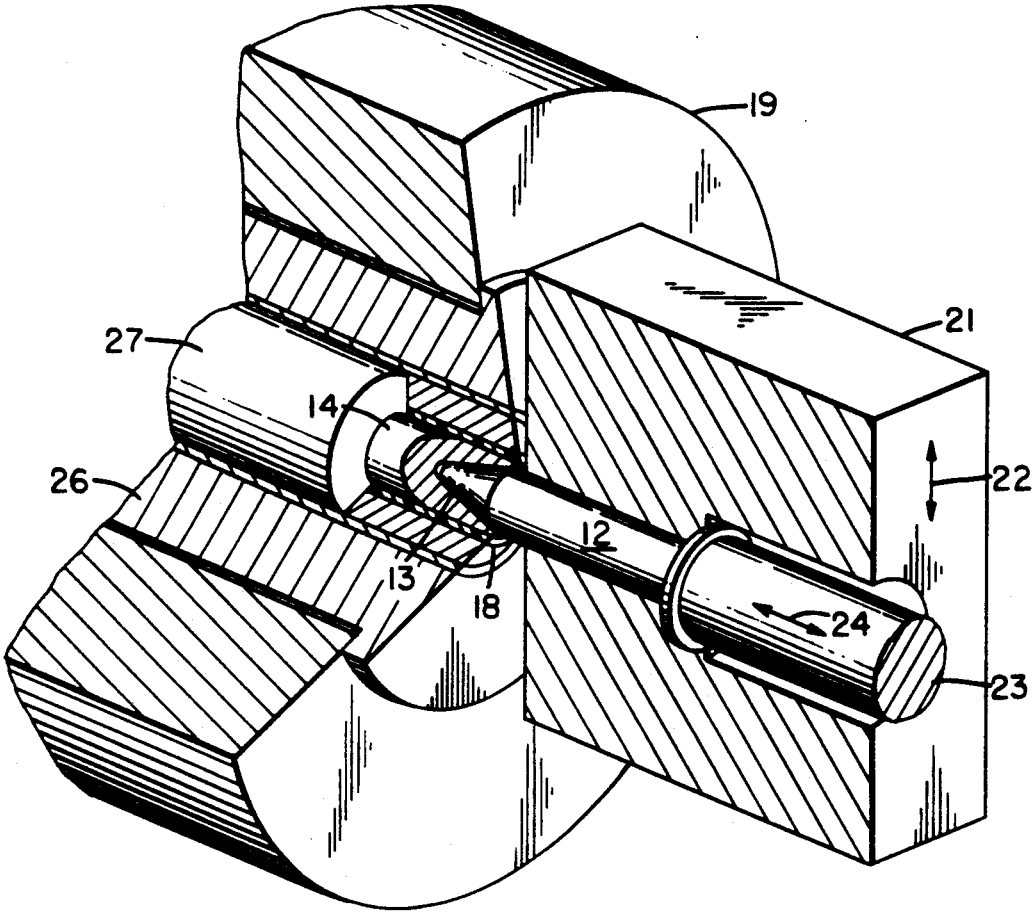
FIG_2
FIG_4
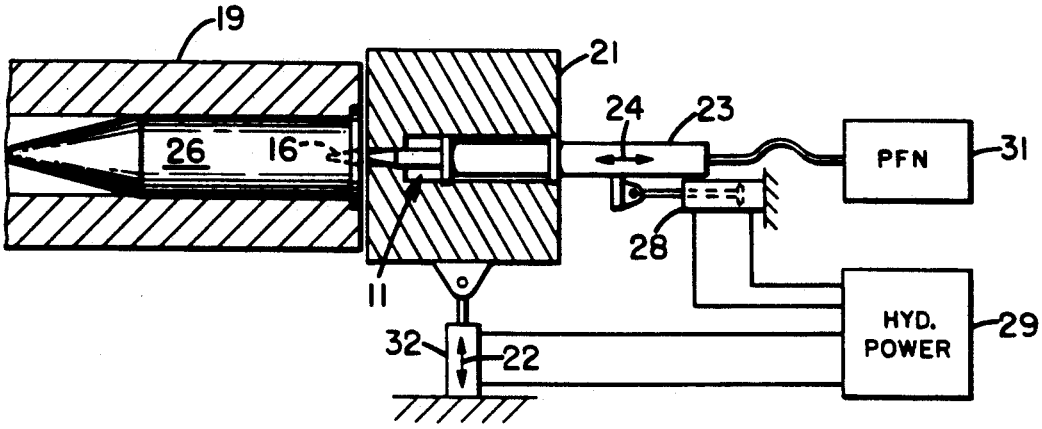

HIGH ENERGY INTERMITTENT POWER CONNECTOR

SUMMARY OF THE INVENTION

The invention disclosed herein is an intermittent contact for transferring energy between an electrical pulse source and an ammunition cartridge situated in a cannon breech closed by a breech block which includes a contact receptacle disposed within the ammunition cartridge substantially on the longitudinal axis of the cartridge. The receptacle has a contact cove which is accessible from the rear thereof. A contact rod is provided for mating with the contact cove together with means for mounting the contact rod in the breech block for movement between a position extending therefrom and a position retracted therein in substantial alignment with the contact cove. Means is also provided for selectively electrically connecting the contact rod with the electrical pulse source.

In another aspect of the invention a high energy power connector is disclosed for passing a high energy pulse which includes a contact receptacle having a contact cove accessible from one end and a contact rod having one end formed for substantially mating contact with the contact cove. Means is included for mounting the contact rod adjacent the one end of the contact receptacle for movement between a position in contact with the contact cove and a position remote therefrom. Further means is provided for preloading the contact between the contact rod and the contact cove to a predetermined pressure in the contact position.

A method is disclosed for intermittently transferring high energy pulse levels from a pulse source through axially aligned cylindrical mechanical contacts with minimal power loss including the steps of selectively moving the mechanical contacts axially between the contact position and a separated position and preloading the contact force to a predetermined level in the contact position. Further, the method includes the steps of axially holding the contacts substantially rigidly in the contact position during pulse transfer to prevent contact bounce and providing for positive contact between the aligned cylindrical contacts at surfaces thereon remote from the aligned axes thereof.

BRIEF DESCRIPTION OF THE DRAWINGS

FIG. 1A is a partial section view of the contacts of the present invention incorporated in separated positions.

FIG. 1B shows the contacts of FIG. 1A in connected position.

FIG. 2 is a perspective section view of the present invention in a combustion augmented plasma gun.

FIG. 3A shows one embodiment of the contacts of the present invention.

FIG. 3B shows another embodiment of the contacts of the present invention.

FIG. 4 is a simplified block type depiction of the present invention in a combustion augmented plasma gun.

DESCRIPTION OF THE PREFERRED EMBODIMENTS

The high energy intermittent power connector disclosed herein is designed for transferring more than two megajoules of electrical power and over 280 kiloamps for short durations on the order of two to five miliseconds from a pulse forming network or pulse source to electrothermal ammunition in the breech of a combustion augmented plasma gun. Specifically this disclosure relates to electrical contacts which have low contact resistance and which transfer such electrical energy to a plasma injector integrated in the electrothermal ammunition cartridge. The plasma injector, which includes the plasma capillary, is supplied with each new round of electrothermal ammunition that is loaded into the gun. U.S. Pat. No. 4,895,062, Chryssomallis et al contains a disclosure of typical ammunition for use in a combustion augmented plasma gun, wherein the high energy pulse forming network, plasma injector and included capillary are attached to the gun breech block and stay with the cannon as successive ammunition rounds are fired therefrom. The present invention is distinct from earlier systems inasmuch as the plasma injector and capillary are included in the ammunition round together with the propellant fuel and oxidizer and the pulse forming network remains with the gun after a round is fired. The problem with regard to how to transfer the high energy pulse from the pulse forming network to the ammunition integrated plasma injector while avoiding damage to and failure of the energy transferring contacts is the subject of this invention as will now be described.

The transfer contacts for the high energy pulse are shown in FIGS. 1A and 1B. FIG. 1A shows a probe or male contact 11 fabricated from some conductive material (i.e., aluminum, copper, etc.) as a cylindrical body 12 terminated on one end by a conical surface 13. A contact receptable 14 is seen having a conical cove 16 formed in one end thereof. The embodiment depicted in FIGS. 1A and 1B is shown in perspective in FIG. 3B. A number of longitudinal slits 17, eight slits being preferred, are formed in the receptacle extending from the outside diameter of the generally cylindrical receptacle into the cove 16. The result is a plurality of "fingers" on the end of the receptacle 14 surrounding the cove 16 which generally lie parallel to the axis of the receptacle.

As may be seen in FIG. 1B, the probe 11 may be moved toward the receptacle 14 so that the conical surface 13 is in contact with the inside conical surface of the cove 16. An insulating ring 18 is shown surrounding the diameter of the receptacle 14 external of the cove 16. The insulator serves to isolate the power pulse from the return conducting path, as will hereinafter be described, and also to stabilize the "fingers" surrounding the cove 16 in FIGS. 1A, 1B and 3B so that they are not wedged apart when the conical surface 13 on probe 11 is inserted into the cove 16.

The embodiment of FIG. 3A shows the probe 11, substantially cylindrical in shape, axially aligned with a receptacle **14*a* having a cove 16*a* with an inside surface substantially complementary to the conical surface 13 on the probe. The embodiment of FIG. 3A is shown with the probe 11 in a position remote from the receptacle 14*a*. With the probe 11 inserted into the cove 16*a*, a depiction of the resulting contact may be visualized by reference to FIG. 1B. The insulator 18 is also installed though not shown on the outside diameter of the receptacle 14*a* overlying the conical cove 16*a*** therein.

Turning now to FIG. 2, a cannon breech 19 is shown in section having a breech block 21 disposed therebehind. The breech block is disposed for vertical movement relative to the breech 19 as represented by the arrow 22. A cable and probe holder 23 is shown disposed within the breech block 21 disposed for movement therein in the direction of the arrow 24. As a consequence, the probe 11 which extends through a hole in the breech block 21 running in the direction of arrow 24, may be disposed in a position extending from the breech block 21 and therefore in a contacting position within cove 16 and a position withdrawn into the breech block and therefore in a remote or no contact position relative to cove 16. FIG. 2 shows the probe and receptacle in contact.

An electrothermal ammunition round 26 is shown within the breech 19 having a plasma injector 27 disposed therein which includes the plasma capillary as discussed in the disclosure of U.S. Pat. No. 4,895,062 referenced hereinbefore. However, the plasma injector 27 in the invention disclosed herein is seen to be disposed within the cartridge 26. A receptacle 14 is shown also within the cartridge 26 having the cove 16 axially aligned within the cartridge and accessible from the rear thereof. When the breech block 21 is in the closed position as shown in FIG. 2, the cylindrically configured probe 11 is axially aligned with the likewise cylindrically configured receptacle 14. The insulator 18 is shown surrounding the receptacle 14 and the conical surface 13 is in contact with the inner surface of the cove 16 in the same manner as depicted in FIG. 1B.

The disclosed invention in the best known mode is about ½ inch in diameter and less than 1 inch long. It is capable of transmitting over 280 kiloamps and over 2 megajoules of electrical energy. The contact receptacle and probe 14 and 15 are coaxial when the breech block is closed and are located along the axis of symmetry of ammunition round 26. As a result, the ammunition is not required to be indexed in any fashion within the cannon breech. Further, the contacts are self-aligning by reason of the complementary conical contact surfaces 16 and 13.

A firing sequence for the apparatus of FIG. 2 begins with the probe or power rod 11 retracted into the breech block 21 and the breech block held in the lowered position indicated by the bottom portion of the arrow 22. Breech 19 is thus open to accept a new round of ammunition 26. The ammunition is inserted into the breech in the same fashion as conventional ammunition. The breech block is then raised in the direction of the upper portion of the arrow 22 to close the breech and the power rod is extended from the breech block into the rear of the ammunition round to contact the conical cove 16 in the receptacle 14 mounted therein. The probe 11 is preloaded to provide a predetermined axial loading force or pressure between the contact surfaces 16 and 13. Following contact, an electrical pulse is coupled to the cable 23 to be transferred through the contact probe 11 and receptacle 14 into the plasma injector 27. Plasma is generated in the capillary (not shown) of the plasma injector as described in the aforementioned U.S. Pat. No. 4,895,062. The resulting reaction within the cartridge as described therein provides for launching the projectile contained in the gun represented by the breech 19. Power cable 23 is then grounded at the pulse source, the probe 11 is retracted into the breech block 21, the breech block is lowered in the direction of arrow 22 and the spent round 26 is retracted from the breech 19. This cycle is repeated for subsequent firing of the cannon.

The material from which the contacts (probe 11 and receptacle 14) are made is conventional good electrical conducting material such as copper, aluminum and silver and tin plated conducting materials by way of example. Contact shape and preload between the contact surfaces 16 and 13 are important. Under pulsed power transfer conditions, the distribution of current through the cross section of the probe and receptacle when contacted is non-uniform. The highest current density is formed on the outer skin of the conducting contacts and the current profile drops exponentially toward the center of the conducting paths. Thus, the complementary conical shapes are used whereby contact is most positive near the outside diameter of the probe and receptacle 11 and 14 and a clearance may exist between the nose of the conical surface 13 and the end of the cove 16 when the probe 11 is extended to contact receptacle 14 as best seen in FIG. 1B. The clearance at the nose of the conical surface 13 removes certain restrictions with regard to manufacturing tolerances of the parts.

Relatively high contact force, between 1400 and 2100 pounds of preload force, is applied between the probe 11 and the receptacle 14 for optimal energy transfer therethrough. Maximum interface pressure between surfaces 16 and 13 occurs at the minimum cove angle. However, smaller cove angles require larger insertion strokes and provide a higher probability for binding misalignment between the probe and receptacle. An optimum compromise was determined to be a cone angle of 10 degrees. The surfaces of the cone 13 and the cove 16 are at a 10 degree departure from the axes of the probe or power rod 11 and receptacle 14 respectively.

The slits 17 provide an advantage when it is considered that the majority of the current flows through the outer portions of the conductor provided by the contact between the probe and the receptacle. The "fingers" provided by the slits 17 act as though they were parallel conductors, thus attracting each other while current is flowing therethrough. This attraction force results in the "fingers" squeezing the power rod thereby increasing the contact force between the surfaces 13 and 16. Since higher contact forces lower contact resistance thereby allowing higher peak current, the slit receptacle provides for lower closure or preload forces between the probe and receptacle while yet obtaining required high current flow therethrough.

As seen in FIG. 4 of the drawings, a power rod or proble 11 is disposed within the breech block 21, shown in the retracted position within the breech block. Means such as a hydraulic cylinder 28 is coupled to the power rod to move the power rod between the extended and retracted positions within the breech block. The hydraulic cylinder is energized by a hydraulic power source 29 to provide for retraction and extension. A pulse forming network (PFN) 41 is coupled electrically to the cable 23 for providing energy transfer through the breech block. The probe retraction and extension apparatus, including the hydraulic cylinder 28, may be used to provide axial stiffness for the probe 11 so that during firing the probe will not experience "contact bounce" and separate from the receptacle. Such separation during energy transfer would cause arcing and destruction of the contacts. Thus, the probe 11 is not only preloaded to the range 1400–2100 pounds force mentioned hereinbefore, but is also held rigidly in place axially or provided with axial stiffness to avoid the aforementioned contact bounce.

The schematic depiction of FIG. 4 also shows a hydraulic cylinder 32, for purposes of illustration, which alternately actuates the breech block 21 in the two directions of the arrow 22 to thereby open and close the breech block. The cylinder 32 is also shown diagrammatically as powered by the hydraulic power source 29. It is to be understood that the diagram of FIG. 4 is for the purpose of illustrating one combination of the elements associated with the invention which have been mentioned hereinbefore.

Tests have shown that the contact depicted in FIGS. 1A, 1B and 3B have conducted slightly over 300 kiloamps and over 2.4 megajoules of energy with contact preload forces in the 1400 to 2100 pound range. The result is a continuously reusable power rod or probe 11 with receptacle and plasma injector mechanisms integrated with each round of electrothermal ammunition.

Although the best mode contemplated for carrying out the present invention has been herein shown and described, it will be apparent that modification and variations may be made without departing from what is regarded to be the subject matter of the invention.

What is claimed is:

1. An intermittent contact for transferring high energy pulses between an electrical pulse source and an ammunition cartridge having an axis situated in a cannon breech closed by a breech block, comprising:

a contact receptacle having a plurality of slits disposed within the ammunition cartridge coaxial with the axis thereof and having a contact cove accessible from the rear thereof;

said plurality of slits extending from the outside of said contact receptacle into said contact cove, whereby a plurality of fingers are formed thereon;

a contact rod having first and second ends and further having conical surfaces at said first end for mating with conical surfaces at said contact cove;

means for mounting said contact rod in the breech block for movement between a position extending therefrom and a position retracted therein in alignment with said contact cove; and means for selectively electrically connecting said contact rod with said electrical pulse source.

2. The intermittent contact of claim 1 comprising means for preloading contact between said contact rod and said contact cove for mating with conical surfaces at said contact cove to thereby prevent contact bounce.

3. The intermittent contact of claim 1 wherein said plurality of fingers lie parallel to the axis of said receptacle.

4. The intermittent contact of claim 1 further comprising an insulating ring surrounding the diameter of said receptacle external of said conical cove.

5. The intermittent contact of claim 4 wherein said ring stabilizes said fingers surrounding said conical cove.

6. A high energy power connector for passing a high energy pulse, comprising:

a contact receptacle having a plurality of slits disposed within an ammunition cartridge having a contact cove and accessible from the rear thereof;

said plurality of slits extending from the outside of said contact receptacle into said contact cove, whereby a plurality of fingers are formed thereon;

a dielectric sleeve surrounding said plurality of fingers to restrict outside motion thereof;

a contact rod having first and second ends and further having conical surfaces at said contact cove; and means for selectively electrically connecting said contact rod with said high energy pulse.

7. The high energy power connector of claim 6 wherein said conical surfaces are complementary to provide self-alignment.

8. The high energy power connector of claim 7 wherein said fingers squeezably secure said contact rod to thereby increase the contact force between said surfaces.

9. An intermittent contact for transferring high energy pulses between an electrical pulse source and an ammunition cartridge situated in a cannon breech closed by a breech block, comprising:

a contact receptacle having a plurality of longitudinal slits disposed within the ammunition cartridge coaxial with the axis thereof and having a contact cove accessible from the rear thereof;

said plurality of longitudinal slits extending from the outside of said contact receptacle into said contact cove, whereby a plurality of fingers are formed thereon;

a dielectric sleeve surrounding said plurality of fingers;

a contact rod having first and second ends and further having conical surfaces at said first end for mating with conical surfaces at said contact cove;

means for mounting said contact rod in the breech block for movement between a position extending therefrom and a position retracted therein in alignment with said contact cove; and means for selectively electrically connecting said contact rod with said electrical pulse source.

10. The intermittent contact of claim 9 wherein said plurality of fingers lie parallel to the axis of said receptacle.

11. The intermittent contact of claim 9 wherein said contact receptacle comprises a continuous conical surface cove.

12. The intermittent contact of claim 9 further comprising an insulating ring surrounding the diameter of said receptacle external of said conical cove to thereby provide stabilization to said fingers.

13. The intermittent contact of claim 9 wherein said contacts are matingly self-aligning at said conical contact surfaces.

* * * * *